US012635809B2

(12) United States Patent
Yang et al.

(10) Patent No.: US 12,635,809 B2
(45) Date of Patent: May 26, 2026

(54) MATTRESS WITH ACCESSIBLE CORES

(71) Applicant: Sleep Number Corporation, Minneapolis, MN (US)

(72) Inventors: Chee Nong Yang, Princeton, MN (US); Nathan Robert Johnson, Lakeville, MN (US); Eric Rose, Piedmont, SC (US)

(73) Assignee: Sleep Number Corporation

( * ) Notice: Subject to any disclaimer, the term of this patent is extended or adjusted under 35 U.S.C. 154(b) by 349 days.

(21) Appl. No.: 18/203,840

(22) Filed: May 31, 2023

(65) Prior Publication Data

US 2023/0389717 A1 Dec. 7, 2023

Related U.S. Application Data

(60) Provisional application No. 63/347,673, filed on Jun. 1, 2022.

(51) Int. Cl.
*A47C 27/18* (2006.01)
*A47C 27/15* (2006.01)

(52) U.S. Cl.
CPC ..... *A47C 27/18* (2013.01); *A47C 27/15* (2013.01)

(58) Field of Classification Search
CPC ..... A47C 27/144; A47C 27/146; A47C 27/15; A47C 27/18; A61G 7/05715
USPC ..... 5/706, 710, 711, 713
See application file for complete search history.

(56) References Cited

U.S. PATENT DOCUMENTS

| | | | | |
|---|---|---|---|---|
| 4,644,597 | A | 2/1987 | Walker | |
| 4,766,628 | A | 8/1988 | Walker | |
| 4,788,729 | A | 12/1988 | Walker | |
| D300,194 | S | 3/1989 | Walker | |
| 4,829,616 | A | 5/1989 | Walker | |
| 4,890,344 | A | 1/1990 | Walker | |
| 4,897,890 | A | 2/1990 | Walker | |
| 4,908,895 | A | 3/1990 | Walker | |
| D313,973 | S | 1/1991 | Walker | |
| 4,991,244 | A * | 2/1991 | Walker | A47C 27/082 5/713 |
| 5,144,706 | A | 9/1992 | Walker | |
| 5,170,522 | A | 12/1992 | Walker | |
| D368,475 | S | 4/1996 | Scott | |
| 5,509,154 | A | 4/1996 | Shafer et al. | |
| 5,564,140 | A | 10/1996 | Shoenhair et al. | |
| 5,642,546 | A * | 7/1997 | Shoenhair | A47C 27/148 5/736 |

(Continued)

FOREIGN PATENT DOCUMENTS

| | | | |
|---|---|---|---|
| DE | 19812382 C2 * | 7/2000 | A47C 27/148 |
| EP | 1031302 | 8/2000 | |

(Continued)

OTHER PUBLICATIONS

Machine Translation of DE-19812382-C2.*

(Continued)

*Primary Examiner* — David R Hare
(74) *Attorney, Agent, or Firm* — Norton Rose Fulbright US LLP

(57) ABSTRACT

A mattress including a mattress core and a foam chamber surrounding six sides of the mattress core, and having a bottom layer with a slit separating a first portion of the bottom layer from a second portion of the bottom layer.

19 Claims, 9 Drawing Sheets

(56) References Cited

U.S. PATENT DOCUMENTS 5,652,484 A 7/1997 Shafer et al.
5,765,246 A 6/1998 Shoenhair
5,903,941 A 5/1999 Shafer et al.
5,904,172 A 5/1999 Gifft et al.
5,960,496 A * 10/1999 Boyd ..... A47C 27/18 5/931
6,037,723 A 3/2000 Shafer et al.
6,101,653 A * 8/2000 England ..... A47C 31/105 5/737
6,108,844 A 8/2000 Kraft et al.
6,161,231 A 12/2000 Kraft et al.
6,202,239 B1 3/2001 Ward et al.
6,256,821 B1 7/2001 Boyd
6,397,419 B1 6/2002 Mechache
6,483,264 B1 11/2002 Shafer et al.
6,686,711 B2 2/2004 Rose et al.
6,708,357 B2 3/2004 Gaboury et al.
6,763,541 B2 7/2004 Mahoney et al.
6,804,848 B1 10/2004 Rose
6,832,397 B2 12/2004 Gaboury et al.
D502,929 S 3/2005 Copeland et al.
6,883,191 B2 4/2005 Gaboury et al.
7,389,554 B1 6/2008 Rose
7,661,166 B1 * 2/2010 Marling ..... A47C 27/148 5/691
7,861,342 B1 * 1/2011 Huang ..... A47C 27/056 5/716
7,865,988 B2 1/2011 Koughan et al.
8,336,369 B2 12/2012 Mahoney
8,347,436 B2 * 1/2013 Flick ..... A61G 7/05784 5/717
D691,118 S 10/2013 Ingham et al.
D697,874 S 1/2014 Stusynski et al.
D698,338 S 1/2014 Ingham et al.
D701,536 S 3/2014 Shakal et al.
8,769,747 B2 7/2014 Mahoney et al.
8,893,339 B2 11/2014 Fleury et al.
8,931,329 B2 1/2015 Mahoney et al.
8,966,689 B2 3/2015 McGuire et al.
8,973,183 B1 3/2015 Palashewski et al.
D728,254 S 5/2015 Blazar et al.
D737,250 S 8/2015 Ingham et al.
9,314,118 B2 4/2016 Blazar et al.
9,578,941 B2 2/2017 MacLachlan et al.
9,730,524 B2 8/2017 Chen et al.
9,737,154 B2 8/2017 Mahoney et al.
D809,843 S 2/2018 Keeley et al.
D812,393 S 3/2018 Karschnik et al.
9,924,813 B1 3/2018 Basten et al.
10,058,190 B1 * 8/2018 Blazar ..... A47C 27/082
10,143,312 B2 12/2018 Brosnan et al.
D840,732 S 2/2019 Peterson et al.
10,194,753 B2 2/2019 Fleury et al.
10,285,508 B2 5/2019 Rose et al.
D857,433 S 8/2019 Kiekhoefer et al.
10,531,745 B2 1/2020 McGuire et al.
10,539,170 B2 1/2020 Peterson et al.
10,575,654 B2 3/2020 Shakal
10,582,779 B2 * 3/2020 Roma ..... A61G 7/05715
10,677,232 B2 6/2020 Shakal et al.
10,729,253 B1 8/2020 Gaunt
10,765,224 B2 9/2020 Chen et al.
10,813,470 B2 10/2020 Mahoney et al.
10,888,173 B2 1/2021 Shakal et al.
10,993,546 B2 5/2021 Shakal et al.
11,001,447 B2 5/2021 Shutes et al.
11,019,934 B2 6/2021 Defranks et al.
11,085,479 B2 8/2021 Griffith et al.
11,096,502 B2 8/2021 Rose et al.
D932,808 S 10/2021 Keeley
11,140,999 B2 10/2021 Peterson et al.
11,229,297 B2 1/2022 Gaunt
11,484,128 B2 11/2022 Stusynski et al.
D982,360 S 4/2023 Negus
11,751,697 B2 9/2023 Grutta et al.
11,786,050 B2 * 10/2023 Deragon ..... A47C 27/061 5/738
12,137,816 B2 * 11/2024 Nolte ..... G06Q 30/0601
2002/0069462 A1 6/2002 Gaboury et al.
2005/0204475 A1 9/2005 Schmitz et al.
2005/0235417 A1 10/2005 Koughan et al.
2008/0052830 A1 3/2008 Koughan et al.
2008/0201856 A1 * 8/2008 Howard ..... A47C 31/123 5/690
2009/0100606 A1 * 4/2009 An ..... A47C 27/15 5/690
2010/0043148 A1 2/2010 Rose et al.
2010/0170042 A1 7/2010 Rose
2010/0170043 A1 7/2010 Young et al.
2013/0025069 A1 1/2013 Ruehlmann et al.
2014/0250597 A1 9/2014 Chen et al.
2015/0007393 A1 1/2015 Palashewski
2015/0182418 A1 7/2015 Zaiss
2015/0359351 A1 * 12/2015 Wilder ..... A47C 31/023 5/709
2018/0125259 A1 5/2018 Peterson et al.
2019/0082855 A1 3/2019 Brosnan et al.
2020/0187667 A1 6/2020 Shakal
2020/0359805 A1 11/2020 Brosnan et al.
2020/0375369 A1 12/2020 Negus et al.
2020/0400135 A1 12/2020 Shakal et al.
2021/0145183 A1 5/2021 Negus et al.
2021/0145185 A1 5/2021 Negus et al.
2021/0177155 A1 6/2021 McGuire et al.
2021/0235884 A1 * 8/2021 Nolte ..... G06Q 30/0621
2021/0244196 A1 8/2021 Hilden et al.
2021/0251392 A1 8/2021 Shakal
2021/0330090 A1 10/2021 Shakal et al.
2021/0341006 A1 11/2021 Griffith et al.
2022/0192388 A1 6/2022 Smith et al.
2022/0218116 A1 7/2022 Rose et al.
2022/0273118 A1 9/2022 Peterson et al.
2022/0322840 A1 10/2022 Gaunt
2022/0369827 A1 11/2022 Rose et al.
2023/0017015 A1 1/2023 Karschnik et al.
2023/0027288 A1 1/2023 Karschnik
2023/0031563 A1 2/2023 Molina et al.
2023/0057322 A1 2/2023 Shakal
2023/0063979 A1 3/2023 Doffing et al.
2023/0128215 A1 4/2023 Karschnik et al.
2023/0148764 A1 5/2023 Negus et al.
2023/0218088 A1 7/2023 Brosnan et al.

FOREIGN PATENT DOCUMENTS

EP 1149547 10/2001
EP 1149547 A1 * 10/2001 ..... A47C 27/20
WO WO 2023/003723 1/2023

OTHER PUBLICATIONS

U.S. Appl. No. 09/471,592, Shafer, filed Dec. 23, 1999.
U.S. Appl. No. 14/594,843, Rose et al., filed Jan. 12, 2015.
U.S. Appl. No. 18/196,658, Herman et al., filed May 12, 2023.
U.S. Appl. No. 18/203,840, Yang et al., filed May 31, 2023.
U.S. Appl. No. 18/221,628, Karschnik et al., filed Jul. 13, 2023.
U.S. Appl. No. 18/222,104, Shakal et al., filed Jul. 14, 2023.
U.S. Appl. No. 18/367,634, Gaunt, filed Sep. 13, 2023.
U.S. Appl. No. 18/377,932, VerBockel et al., filed Oct. 9, 2023.
U.S. Appl. No. 18/382,902, Doffing et al., filed Oct. 23, 2023.
U.S. Appl. No. 29/719,090, Negus et al., filed Dec. 31, 2019.
U.S. Appl. No. 29/821,785, Negus et al., filed Jan. 3, 2022.
International Search Report and Written Opinion in International Appln. No. PCT/US2023/0023945, mailed on Oct. 25, 2023, 17 pages.
International Preliminary Report on Patentability in International Appln. No. PCT/US2023/023945, mailed on Dec. 12, 2024, 8 pages.

* cited by examiner

MATTRESS WITH ACCESSIBLE CORES

CROSS-REFERENCE TO RELATED APPLICATIONS

This application claims the benefit of U.S. Provisional Application Ser. No. 63/347,673, filed Jun. 1, 2022. The disclosure of the prior application is considered part of (and is incorporated by reference in) the disclosure of this application.

This document describes devices, systems, and methods related to mattresses with accessible cores.

BACKGROUND

In general, a bed is a piece of furniture used for sleeping and relaxing. Many modern beds include a soft mattress on a bed frame. The mattress may include springs, foam material, and/or air chambers to support the weight of one or more users. Various features and systems have been used in conjunction with beds, including pressure adjustment systems for adjusting firmness of one or more users of the bed.

SUMMARY

The document generally relates to mattresses with multiple mattress components (such as foam, air chambers or other mattress cores) that can be connected to each other. More specifically, the document relates to mattress systems with accessible components such as a core (such as an air chamber core) and a rail structure that surrounds the core to retain the core to the rail structure. Access can be achieved by implementing a slit in a bottom layer that facilitates access to the core and other mattress components.

Particular embodiments described herein include a mattress that includes a mattress core and a foam chamber surrounding six sides of the mattress core, and having a bottom layer with a slit separating a first portion of the bottom layer from a second portion of the bottom layer.

In some implementations, the system can optionally include one or more of the following features. The mattress core can be an inflatable air chamber. The foam chamber can include a plurality of connected layers, where the slit in the bottom layer allows the mattress core to be inserted into the foam chamber. A first portion and a second portion of the bottom layer can be laminated to opposing side rails of the foam chamber. The foam chamber can include a comfort layer laminated to side rails and a bottom layer laminated to the side rails, where a core space is defined by the bottom layer, the comfort layer, and the side rails, where the core space is sized to fit the mattress core.

Particular embodiments described herein include a mattress that includes a mattress core, a top layer positioned above the core, a perimeter rail structure that extends around a perimeter of the core, and bottom layer including a first portion and a second portion that are separated by a slit that allows the mattress core to be inserted into the perimeter rail structure.

In some implementations, the mattress can optionally include one or more of the following features. The first portion and the second portion can be adhered to opposing side rails of the perimeter rail structure. The slit can extend from a head to a foot of the bottom layer. A core space can be defined by the bottom layer, the comfort layer, and the perimeter rail structure and the core space cab be sized to receive the mattress core. The mattress core can include one or more air chambers. The one or more air chambers can include a first air chamber and a second air chamber that extend from a head of the mattress to a foot of the mattress. The air chambers can be connected to each other along a midline of the mattress. The pump system can be configured to inflate the first and second air chambers, and where the first and second portions of the bottom layer define first and second openings extending through the first and second portions proximate the perimeter rail structure through which first and second hoses extend to the first and second air chambers. The mattress may include means for inflating the one or more air chambers. The core can include one or more foam layers. The perimeter rail structure can combine with a top layer to form an inverted foam tub that surrounds top and side portions of the core. The perimeter rail structure can include one or more foam rails including a head rail, a foot rail, and first and second side rails, where the first portion is adhered to the first side rail but not the second side rail, the head rail, or the foot rail, and where the second portion is adhered to the second side rail, but not the first side rail, the head rail, or the foot rail. The perimeter rail structure can include one or more foam rails including a head rail, a foot rail, and first and second side rails, where the first portion is adhered to the first side rail, where the first portion is adhered to only a corner portion of the head rail near the first side rail, where the first portion is adhered to only a corner portion of the foot rail near the first side rail, and where the first portion is not adhered to the second side rail, and where the second portion is adhered to the second side rail, where the second portion is adhered to only a corner portion of the head rail near the second side rail, where the second portion is adhered to only a corner portion of the foot rail near the second side rail, and where the second portion is not adhered to the first side rail. The mattress may include a mattress cover that encloses the mattress core, the top layer, the perimeter rail structure, and the bottom layer.

The devices, system, and techniques described herein may provide one or more of the following advantages. For example, the disclosed embodiments provide for improved structure and improved accessibility to internal components of the mattress system such as access to one or more mattress cores (e.g., air chambers) and additional mattress components within a rail structure. A bottom layer of the mattress system can include a slit that separates a first portion of the bottom layer from a second portion of the bottom layer. The slit can facilitate access to the one or more mattress cores and additional mattress components within the rail structure by allowing the first portion and the second portion of the bottom layer to open and provide access to the internal structure of the mattress system. The accessibility to the one or more mattress cores allows for improved maintenance of the mattress system because the internal components of the mattress system can be accessed and serviced without the need to cut open one or more layers of the mattress system.

The details of one or more implementations are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

This document generally relates to air mattress systems with internal support structures, such as foam, air chambers, springs, or other suitable structures. A core having a plurality of air chambers (or other cores) can be positioned in such a way to provide support and sleeper spine alignment through a range of firmness pressure settings. A foam chamber can surround the core, and have a bottom layer with a slit separating a first portion of the bottom layer from a second portion of the bottom layer.

Figure 1:
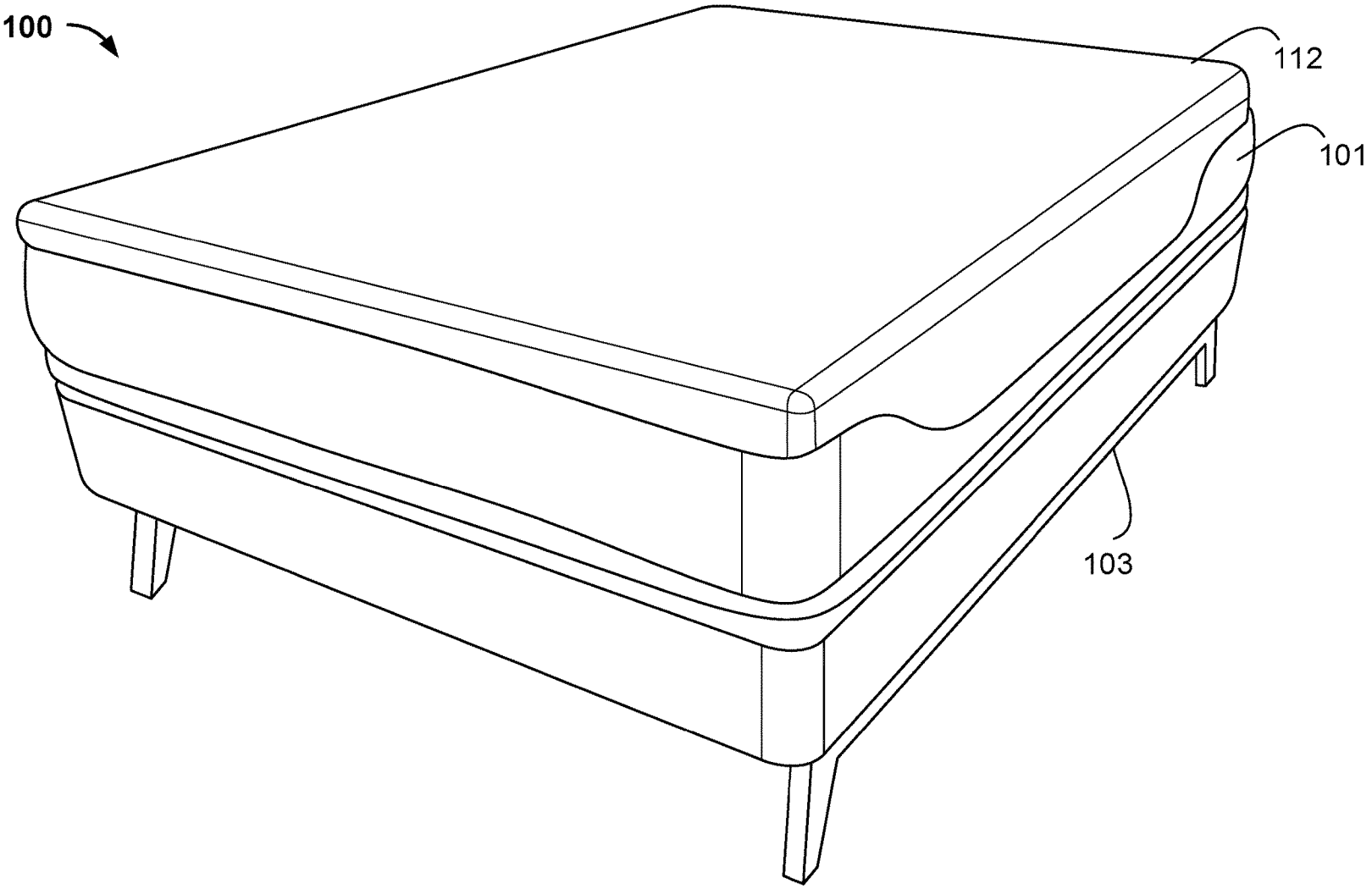
FIG. 1 shows a top perspective view of a mattress system.
Figure 2:
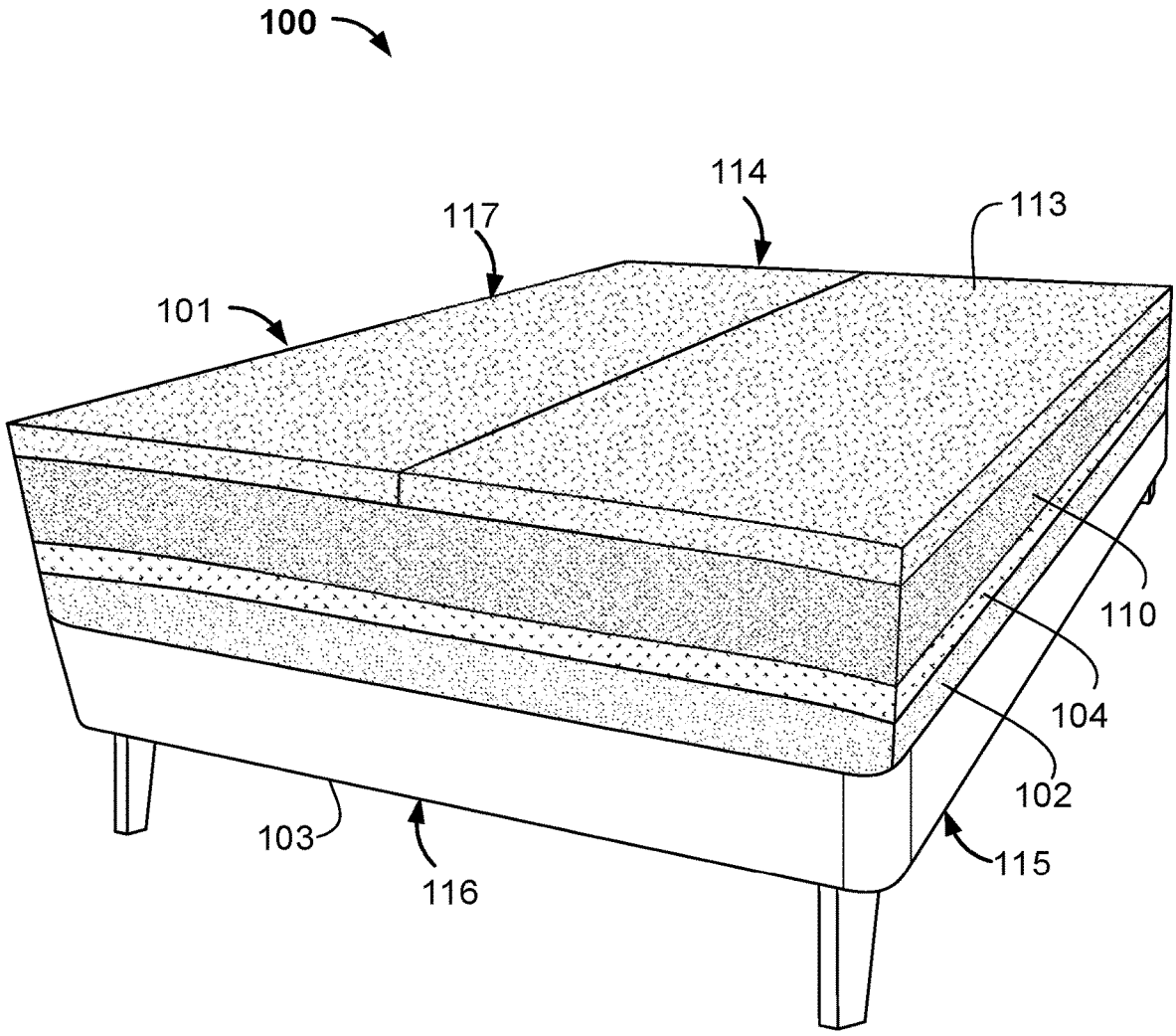
FIG. 2 shows a perspective view of the mattress system of FIG. 1 up-side-down with a cover removed.

Referring to the figures, FIGS. 1 and 2 illustrate an example mattress system 100 as described herein. The mattress system 100 can include a mattress 101 and a foundation (sometimes called a frame) 103. The foundation 103 can support the mattress 101 such that the mattress 101 sits above the ground. FIG. 1 shows the mattress system 100 with a mattress cover 112 over the mattress 101. The mattress system 100 can be configured to support one or more users on the mattress system 100. The mattress cover 112 can cover the components described herein to also maintain the components in place. The mattress cover 112 can be made of one or more fabrics or other similar textile materials. The mattress cover 112 can enclose the entire mattress system 100.

FIG. 2 shows the mattress 101 up-side-down on the foundation 103 with the mattress cover 112 removed from view to illustrate various layers of mattress system 100 that can be covered and/or surrounded by the mattress cover 112. The mattress system 100 can include a top layer 102 (here shown on the bottom because the mattress 101 is shown upside down), a second layer 104, a rail structure 110, and a bottom layer 113 (here shown on the top because the mattress 101 is upside down). The mattress system 100 can include a core 120 (not shown in FIG. 1) that can be inserted within the rail structure 110 under the top layer 102, as described in detail in reference to FIG. 4.

The top layer 102 is positioned at a top surface of the mattress system 100 above the core 120 and the perimeter rail structure 110. The top layer 102 can extend across an entire length of the mattress system 100 from a head end 114 to a foot end 116 of the mattress system 100. The top layer 102 can be made of foam or some similar type of cushioning material, such as synthetic support materials (e.g., polymer materials), springs, natural support materials, or other suitable materials. The top layer 102 can include one or more of any type of material as described throughout this disclosure, such as foam, batting, or other suitable material. For example, the top layer 102 can be positioned between the core 120 and a sleeper on the mattress system 100 and the top layer 102 can include one or more layers of materials (e.g. foam layers). The top layer 102 can provide comfort and/or support to a user resting on the mattress system 100.

In some aspects, the mattress system 100 includes the second layer 104 that can be positioned between the top layer 102 and the rail structure 110. The second foam layer 104 can be made of foam or some similar type of cushioning material, such as synthetic support materials (e.g., polymer materials), springs, natural support materials, or other suitable materials. The second foam layer 104 can include one or more of any type of material as described throughout this disclosure, such as foam, batting, or other suitable material. For example, the top layer 102 can be positioned between the core 120 and the top layer 102. In some examples, the second foam layer 104 can be a part of the top layer 102 when the top layer 102 includes one or more layers of materials (e.g. foam layers).

The rail structure 110 can be a structure positioned at a perimeter of the mattress system 100. The rail structure 110 can be a foam rail structure that includes separate rails at the head end 114 (a head rail), the foot end 116 (a foot rail), the right side 115 (a right rail), and the left side 117 (a left rail), each of the separate rails can be connected to each other (e.g., via adhesives, fasteners, or fastening means). In some embodiments, each of the separate rails (e.g. head end 114, foot end 116, the right side 115, and left side 117) are not directly connected to each other, and each of the separate rails are attached to the top layer 102 and/or the second foam layer 104. For example, each of the separate rails can be connected to a bottom surface of the top layer 102 and/or the second foam layer 104 at a top surface of each of the separate rails. The rail structure 110 can be a foam rail structure that combines with another layer (such as the top layer 102 and/or the second foam layer 104) to form an inverted foam tub where the head end 114, foot end 116, and right and left sides of the rail structure 110 are connected with each other and with the top layer 102 via adhesive, lamination, or other suitable fasteners. The rail structure 110 can be formed of materials other than foam (such as other polymers, other natural materials, springs, etc.), and can be positioned around the perimeter of the mattress system 100. The rail structure 110 provides some shape and/or structural support to the mattress system 100. In some implementations, the core 120 can be inserted within a space defined by the rail structure 110.

Figure 3:
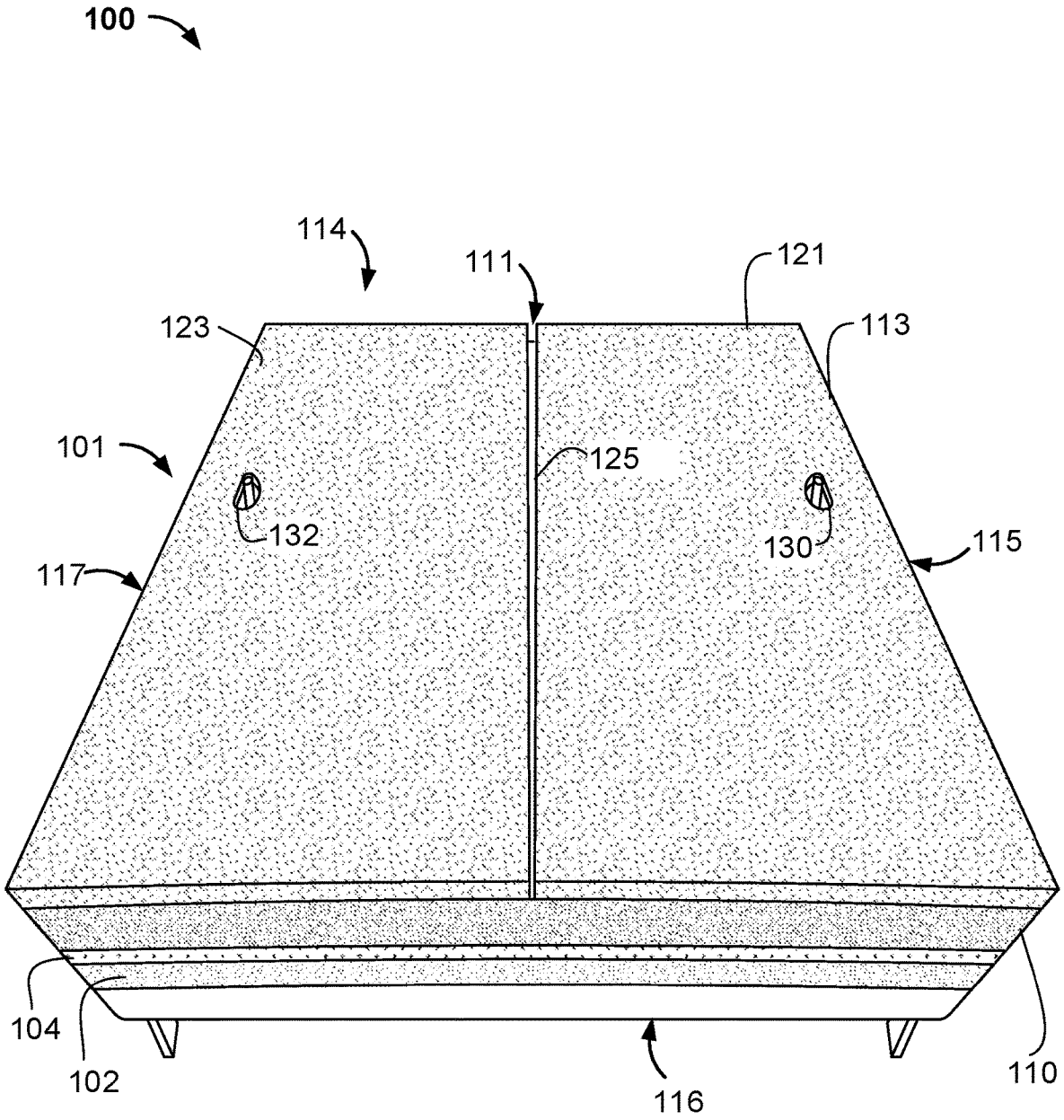
FIG. 3 shows another perspective view of the mattress system of FIG. 1 up-side-down.

FIG. 3 is a top perspective view of the mattress system 100 with the mattress 101 positioned upside-down. FIG. 3 illustrates the bottom layer 113 having a first portion 121 and a second portion 123. The bottom layer 113 can be a base layer of the mattress 101. The first portion 121 can extend from the right side 115 to a slit 125 of the mattress system 100 and the second portion 123 can extend from the left side 117 to the slit 125 of the mattress system 100. The first portion 121 and the second portion 123 are separated by the slit 125 that extends through the bottom layer 113 from the head end 114 to the foot end 116. The slit 125 extends from a bottom surface of the bottom layer 113 to a top surface of the bottom layer 113, and creates a gap between the first portion 121 and the second portion 123. The gap created by the slit 125 can be small enough that the support of the mattress system 100 is not compromised by the separation between the first portion 121 and the second portion 123. In some aspects, the slit 125 can extend along a midline 111 of the mattress system.

The first portion 121 and the second portion 123 are connected to the rail structure 110 along the right side 115 and the left side 117 of the rail structure 110. For example, the first portion 121 can be connected to the right side 115 of the rail structure 110 such that the top surface of the first portion 121 is connected to a bottom surface of the rail structure 110 along the right side 115 from the head end 114 to the foot end 116. The top surface of the first portion 121 can be laminated, adhered, fastened, or otherwise connected to the bottom surface of the rail structure 110 along the right side 115.

The second portion 123 can be connected to the left side 117 of the rail structure 110 such that the top surface of the second portion 123 is connected to a bottom surface of the rail structure 110 along the left side 117 from the head end 114 to the foot end 116. The top surface of the second portion 123 can be laminated, adhered, fastened, or otherwise connected to the bottom surface of the rail structure 110 along the left side 117.

In some embodiments, the first portion 121 has a first opening 130 in the bottom surface of the first portion 121 of the bottom layer 113 and the second portion 123 has a second opening 132 in the bottom surface of the second portion 123 of the bottom layer 113. The first opening 130 and the second opening 132 provide access to components of the core 120 that is positioned within the rail structure 110 above the bottom layer 113, as described in reference to FIG. 5 below.

Figure 4:
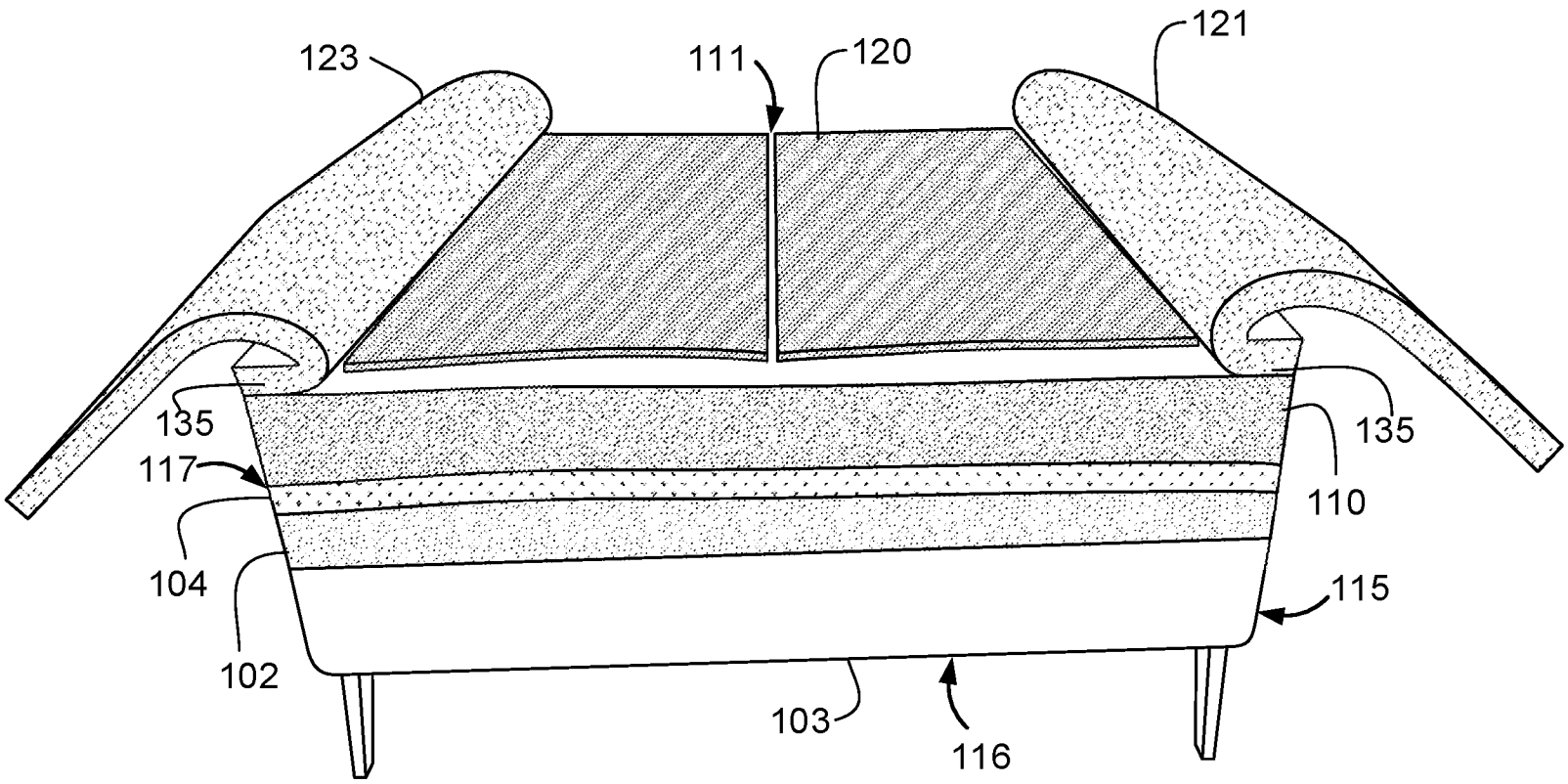
FIG. 4 shows a perspective view of the mattress system of FIG. 1 up-side-down with a bottom layer open.

FIG. 4 illustrates the mattress system 100 upside down with the first portion 121 and the second portion 123 folded away from the slit 125 to show components contained therein. The slit 125 allows the first portion 121 and the second portion 123 to be folded away from each other to open the bottom layer 113 of the mattress system 100. The connection of the first portion 121 to the right side 115 of the rail structure 110 allows the first portion 121 to remain connected to the mattress system 100 when the mattress system 100 is open. The connection of the second portion 123 to the left side 117 allows the second portion 123 to remain connected to the mattress system 100 when then mattress system 100 is open.

In some aspects, the first portion 121 and the second portion 123 can be unattached from a majority of the head end 114 and the foot end 116 of the rail structure 110. The "majority of the head end 114 and foot end 116" can refer to portions of the head end 114 and foot end 116 other than portions that account for a thickness of a connection region 135 for each of the first portion 121 and second portion 123. For example, the first portion 121 can be connected to the rail structure 110 via lamination and/or adhesion along some, most or all of the right side 115. The lamination, adhesion, or other securement can have a width that extends inwardly from the right side 115 towards the midline 111. The width of the lamination, adhesion, or other securement can define the connection region 135. The second portion 123 can be connected to the rail structure 110 via lamination and/or adhesion along some, most or all of the left side 117. The lamination, adhesion, or other securement can have a width that extends inwardly from the left side 117 towards the midline 111. The width of the lamination, adhesion, or other securement can define the connection region 135. The absence of lamination, adhesion, or other securement along the remainder of the head end 114 and foot end 116, along with the slit 125 that separates the first portion 121 and the second portion 123 allows the first portion 121 and the second portion 123 to be folded into the open position shown in FIG. 4.

In some aspects, the first portion 121 is adhered to a first side rail (e.g., the right side 115) but not a second side rail (e.g., the left side 117), the head rail (e.g., head end 114), or the foot rail (e.g., foot end 116). The second portion 123 is adhered to the second side rail (e.g., the left side 117), but not the first side rail (e.g., the right side 116), the head rail (e.g., head end 114), or the foot rail (e.g., foot end 116).

In some aspects, the first portion 121 is adhered to the first side rail (e.g., the right side 115), and the first portion 121 is adhered to only a corner portion of the head rail (e.g., the head end 114) near the first side rail (e.g., the right side 115). The first portion 121 is adhered to only a corner portion of the foot end 116 near the first side rail (e.g., right side 115), and the first portion 121 is not adhered to the second side rail (e.g., left side 117). The second portion 123 is adhered to the second side rail (e.g., the left side 117). The second portion 123 can be adhered only to a corner portion of the head rail (e.g., head end 114) near the second side rail. The second portion 123 can be adhered to only a corner portion of the foot rail near the second side rail. The second portion 123 is not adhered to the first side rail (e.g., the right side 115).

In some aspects, the first portion 121 is adhered to the head rail (e.g., head end 114) but not to the foot rail (e.g., foot end 116), the first side rail (e.g., the right side 115) or the second side rail (e.g., the left side 117). The second portion 123 is adhered to the foot rail (e.g., foot end 116), but not to the head rail (e.g., head end 114), the first side rail (e.g., the right side 115) or the second side rail (e.g., the left side 117).

The core 120 can be received within the rail structure 110. The core 120 can include one or more air chambers, a foam core, a spring core, another core, or combinations thereof. In some aspects, the core 120 includes one or more air chambers 106A, 106B that extend from the head end 114 to the foot end 116. The first air chamber 106A can extend from the right side 115 to the midline 111 of the mattress system 100 and the second air chamber 106B can extend from the left side 117 to the midline of the mattress system 100. The first air chamber 106A and the second air chamber 106B can be connected to each other at the midline 111 via one or more fasteners positioned along the length of each of the air chambers 106A, 106B. The fasteners that connect the first and second air chambers 106A, 106B can include zippers, anchors, snaps, hooks, Velcro® brand hook and loop, or combinations thereof that connect the air chambers 106A, 106B to each other. In some aspects, the first air chamber 106A and the second air chamber 106B can be the same size as each other, or the first air chamber 106A and the second air chamber 106B can be different sizes. The first air chamber 106A and the second air chamber 106B can be connected away from midline 111. In some aspects, mattress system 100 can include more or fewer than two air chambers that may or may not be interconnected.

The mattress system 100 can be sized in a number of suitable mattress sizes, including single, twin, Full, Queen, and King sized beds. In some of such implementations, the mattress system 100 can include a first zone having a first air chamber 106A and a second zone having a second air chamber 106B. The first zone can be used by a first user and the second zone can be used by a second user. In some implementations, such as with Full, Twin, or Single beds, the mattress system 100 may only include the first air chamber 106A. In some embodiments, the second air chamber 106B can be fluidly connected to the first air chamber 106A. In other embodiments, the second air chamber 106B can be fluidly separated from the first air chamber 106A. In some aspects, the mattress system 100 can be sized as a single, a twin, or a split king mattress system. The twin, single, or split king mattress system can include the first portion 121 (and not include the second portion 123) that is dimensioned to fit the single or twin mattress system. In such an implementation, the first portion 121 can be connected to the rail structure 110 via lamination and/or adhesion along some, most or all of the right side 115. The first portion 121 can be otherwise unattached from the rail structure 110, allowing the first portion 121 to be rotated away from the rail structure 110 in a similar manner shown in FIG. 4. The twin, single, or split kind mattress system can differ from FIG. 4 because the first portion 121 can extend across the width of the mattress system 100 and the actuation of the first portion 121 can facilitate access to the inside of the rail structure 110 by actuating the first portion 121 away from the left side 117 rather than the midline 111.

Figure 5:
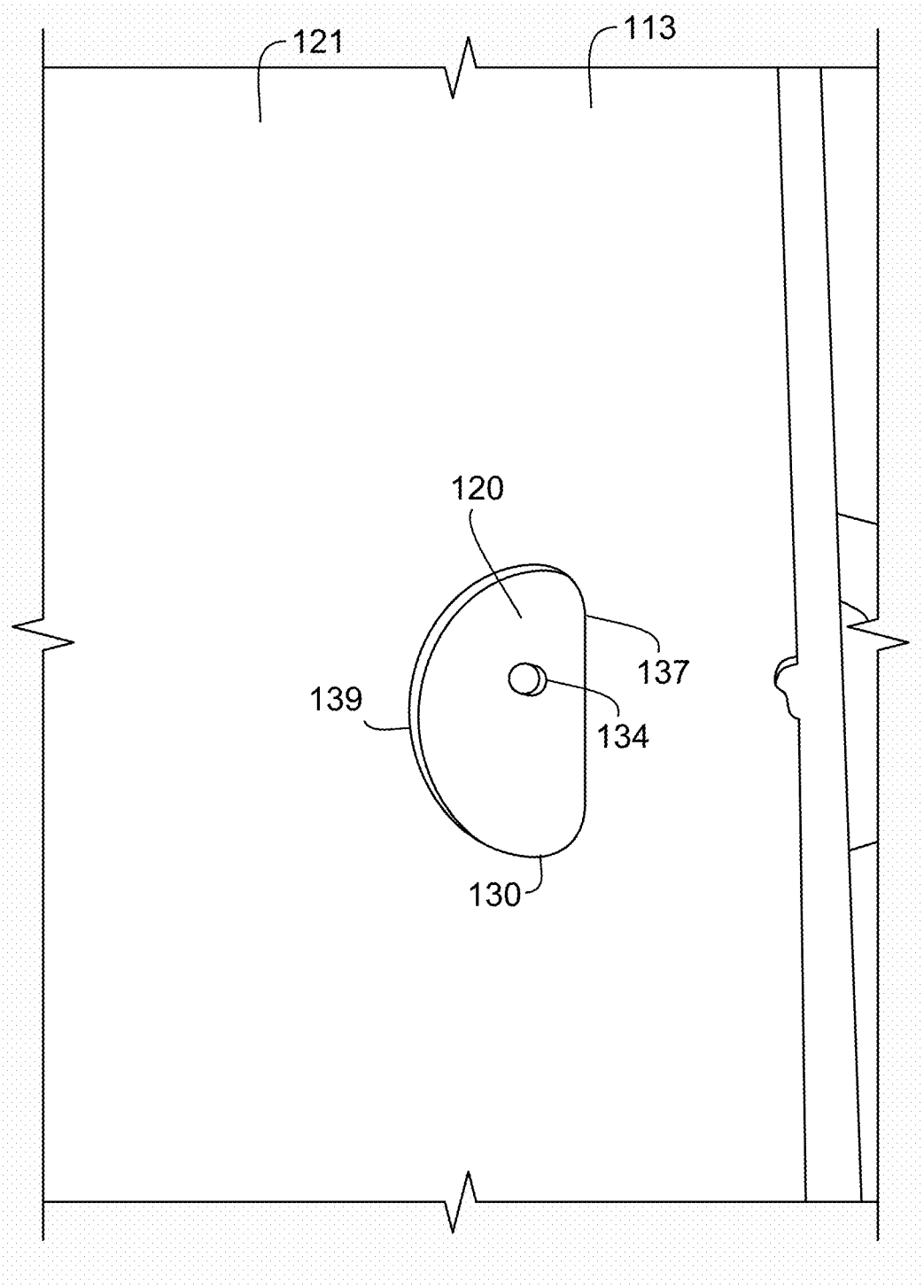
FIG. 5 shows a bottom view of a portion of the bottom layer of the mattress system.

FIG. 5 illustrates an enlarged and detailed view of a portion of the bottom surface of the bottom layer 113 that includes the first opening 130. The first opening 130 can extend from the bottom surface of the bottom layer 113 to the top surface of the bottom layer 113, thereby extending through the thickness of the bottom layer 113. In some implementations, the first opening 130 can have a semi-circular and or semi-ovular shape that includes a flat lateral surface 137 and a curved medial surface 139. While the first opening 130 is shown and described in detail in reference to FIG. 5, the second opening 132 can share some or all the features of the first opening 130. In some aspects, the first opening 130 and the second opening 132 can each have a circular shape.

The first opening 130 can provide access to components of the core 120. For example, the first opening 130 and the second opening 132 are configured to provide access to the core 120 by allowing one or more hoses 134 to pass through the bottom layer 113 at the first opening 130. The one or more hoses 134 can be connected to the first air chamber 106A and the second air chamber 160B. The one more hoses 134 can be in fluid communication with the pump 920. In other embodiments, the first opening 130 can allow passage of other components (such as other liquid or gas fluid conduits, electrical cords, etc.) through the bottom layer 113 at the first opening 130.

Figure 6A:
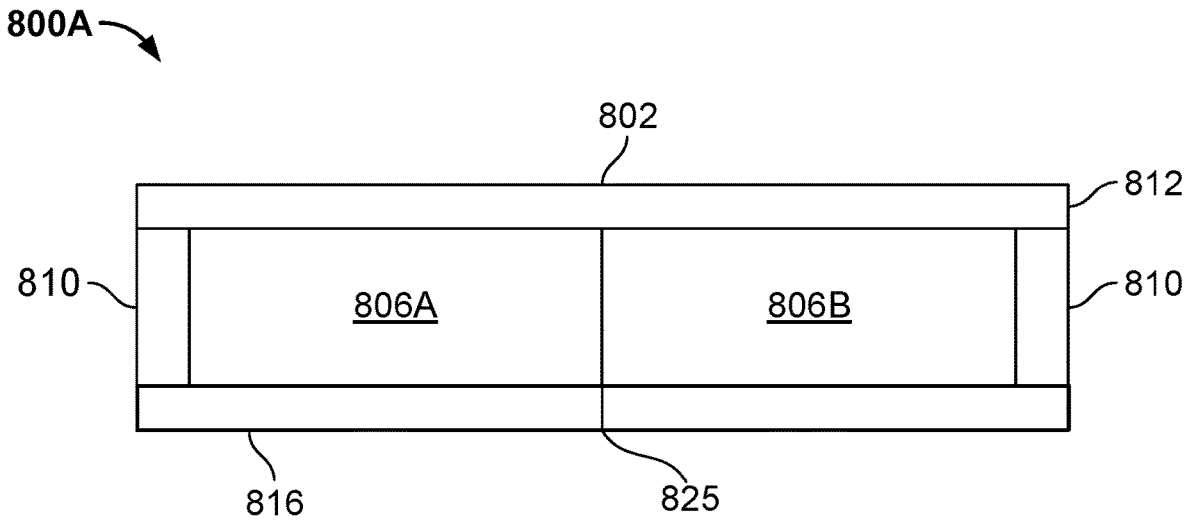
FIG. 6A shows an example configuration of the mattress system having multiple layers.
Figure 6B:
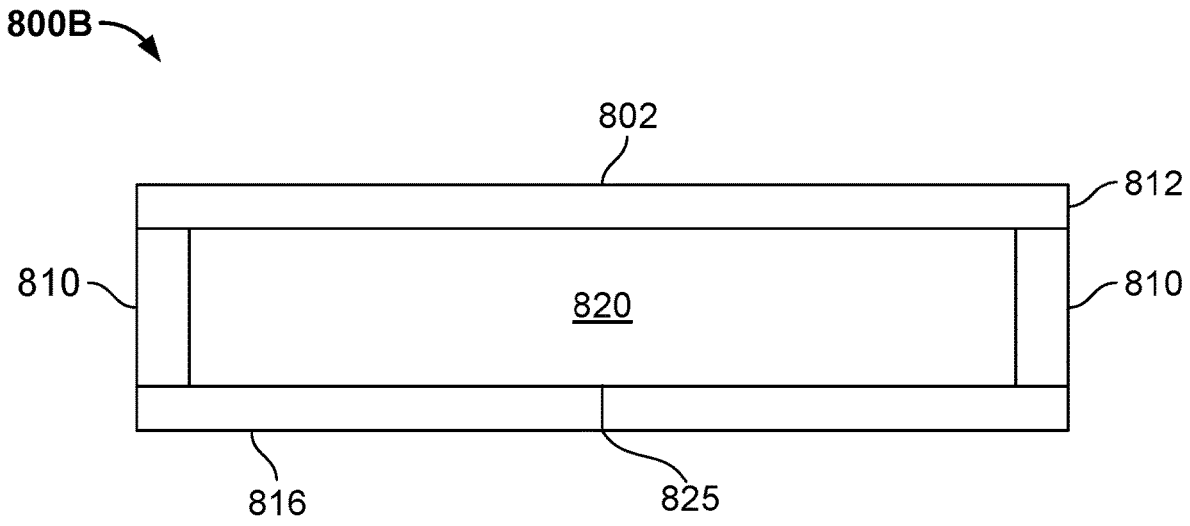
FIG. 6B shows an example configuration of the mattress system having multiple layers.

FIGS. 6A and 6B depict example configurations of the mattress system having one or more layers including a core 820, a rail structure 810, a top layer 802 and a bottom layer 816 as described above. FIG. 6A is a schematic head end 812 view of an example configuration of components of mattress system 800A with the mattress cover 112 removed to show internal components thereof. As shown in this view, the mattress system 800A can include the top layer 802, the rail structure 810, the air chamber 806A, the air chamber 806B, and a bottom layer 816 that includes a slit 825. The mattress cover 112 (not shown in FIG. 6A) can be positioned on an outside of the mattress system 800A. The top layer 802 can extend across an entire length of the mattress system 800A from the head end 812 to the foot end of the mattress system 800A. The top layer 802 can include any type of material as described throughout this disclosure, such as foam, springs, batting, or other suitable material. The top layer 802 can provide comfort and/or support to a user resting on the mattress system 800A.

The air chambers 806A, 806B can extend across some, most, or all of a length of the mattress system 800A. The rail structure 810 can be positioned beneath the top layer 802 and can form a perimeter around the air chambers 806A, 806B. The rail structure 810 can form a perimeter around the air chambers 806A, 806B. The rail structure 810 can provide additional structural support to the mattress system 800A and maintain the air chambers 806A, 806B in place. In addition to the rail structure, anchors can facilitate connection between the air chambers 806A, 806B and the rail structure 810 to maintain the relative positioning of the air chambers 806A, 806B and the rail structure 810 within mattress system 800A.

FIG. 6B is a schematic head end 812 view of an example configuration of components of mattress system 800B with the mattress cover 112 removed to show internal components thereof. As shown in this view, the mattress system 800B shares features with mattress system 800A including the top layer 802, the rail structure 810, the bottom layer 816, and the slit 825. The mattress cover 112 (not shown in FIG. 6B) can be positioned on an outside of the mattress system 800B.

Mattress system 800B includes a core 820, the core 820 can include air chambers (e.g. air chambers 806A, 806B), one or more foam layers, one or more spring layers, and combinations thereof. The core 820 can extend across some, most, or all of a length of the mattress system 800B. The rail structure 810 can be positioned beneath the top layer 802 and can form a perimeter around the core 820. The rail structure 810 can form a perimeter around the core 820. The rail structure 810 can provide additional structural support to the mattress system 800A and maintain the core 820 in place. In addition to the rail structure, anchors can facilitate connection between the core 820 and the rail structure 810 to maintain the relative positioning of the core 820 and the rail structure 810 within mattress system 800A.

Example Airbed Hardware

Figure 7:
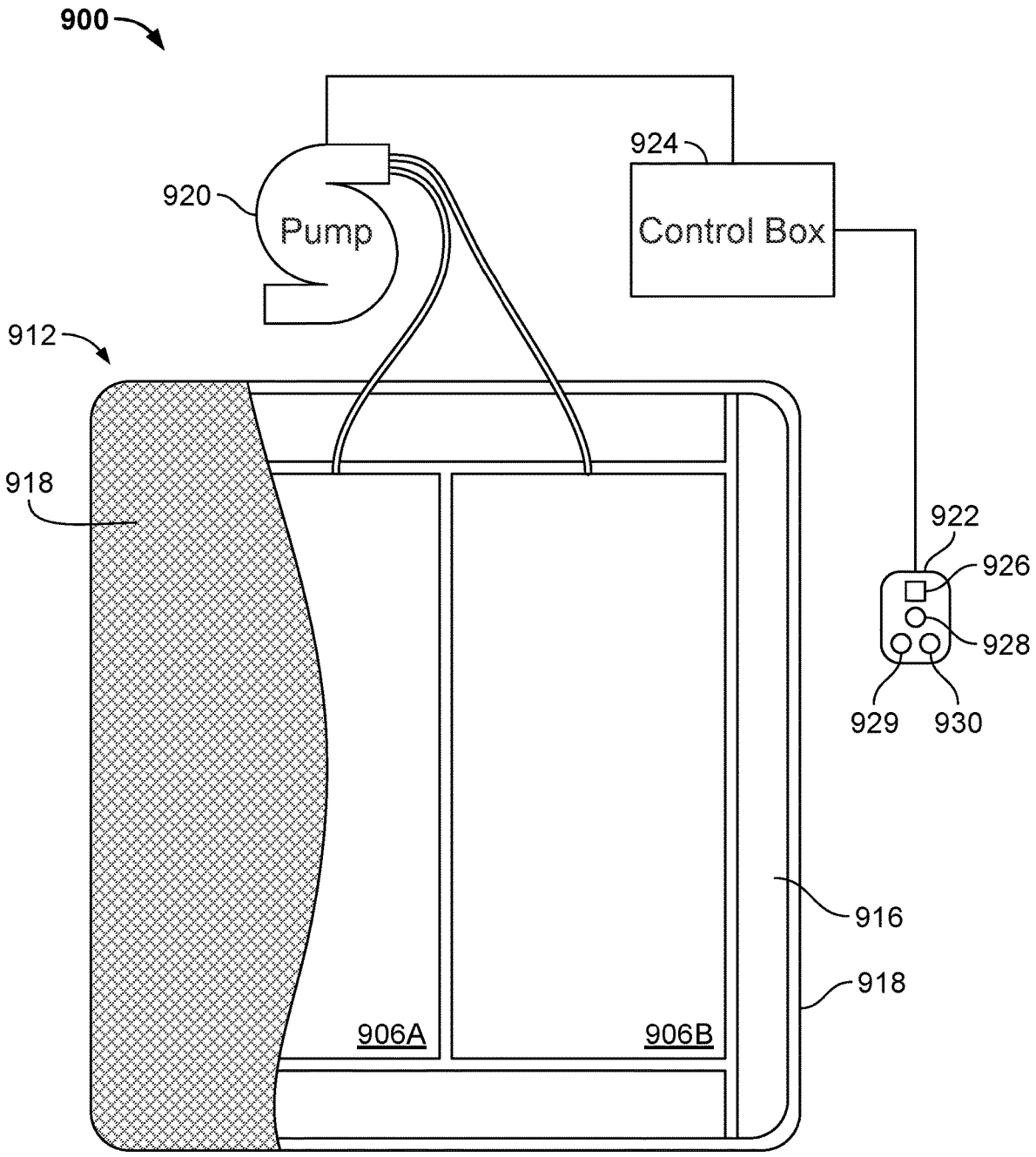
FIG. 7 shows an example air bed system with a pump.
Figure 8:
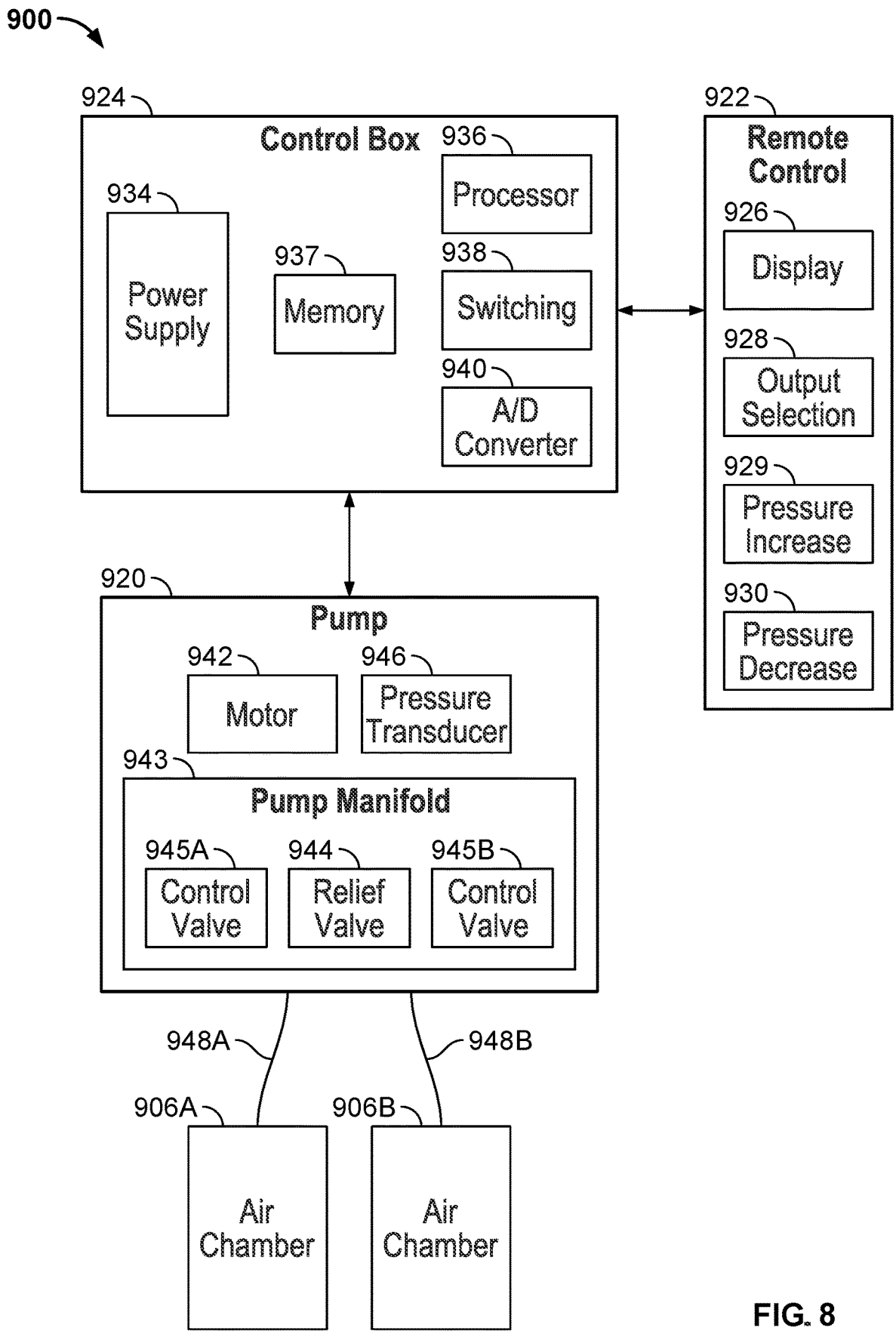
FIG. 8 is a block diagram of an example of various components of an air bed system.

As depicted in FIGS. 7-8, the mattress system 100 can be in fluid communication (via hoses) to a pump 920. The pump 920 can include one or more air pumps that can be fluidly connected to the first and second air chambers 106A, 106B, respectively. The pump 920 can be configured to inflate the first air chamber 106A to a first common internal pressure and to inflate the second air chamber 106B to a second common internal pressure. The first common internal pressure can be different than the second common internal pressure, for example, based on user preference.

FIG. 7 shows an example air bed system 900 that includes a bed 912 that can be implemented and used in the mattress system 100. The bed 912 includes at least one air chamber 914 surrounded by a resilient border 916 and encapsulated by bed ticking 918. The resilient border 916 can comprise any suitable material, such as foam.

As illustrated in FIG. 7, the bed 912 can be a two chamber design having first and second fluid chambers, such as a first air chamber 906A and a second air chamber 906B. In alternative embodiments, the bed 912 can include chambers for use with fluids other than air that are suitable for the application. In some embodiments, such as single beds or kids' beds, the bed 912 can include a single air chamber 906A or 906B or multiple air chambers 906A and 906B. First and second air chambers 906A and 906B can be in fluid communication with a pump 920. The pump 920 can be in electrical communication with a remote control 922 via control box 924. The control box 924 can include a wired or wireless communications interface for communicating with one or more devices, including the remote control 922. The control box 924 can be configured to operate the pump 920 to cause increases and decreases in the fluid pressure of the first and second air chambers 906A and 906B based upon commands input by a user using the remote control 922. In some implementations, the control box 924 is integrated into a housing of the pump 920.

The remote control 922 can include a display 926, an output selecting mechanism 928, a pressure increase button 929, and a pressure decrease button 930. The output selecting mechanism 928 can allow the user to switch air flow generated by the pump 920 between the first and second air chambers 906A and 906B, thus enabling control of multiple air chambers with a single remote control 922 and a single pump 920. For example, the output selecting mechanism 928 can by a physical control (e.g., switch or button) or an input control displayed on display 926. Alternatively, separate remote control units can be provided for each air chamber and can each include the ability to control multiple air chambers. Pressure increase and decrease buttons 929 and 930 can allow a user to increase or decrease the pressure, respectively, in the air chamber selected with the output selecting mechanism 928. Adjusting the pressure within the selected air chamber can cause a corresponding adjustment to the firmness of the respective air chamber. In some embodiments, the remote control 922 can be omitted or modified as appropriate for an application. For example, in some embodiments the bed 912 can be controlled by a computer, tablet, smart phone, or other device in wired or wireless communication with the bed 912.

FIG. 8 is a block diagram of an example of various components of a bed system. For example, these components can be used in the example mattress system 100 and air bed system 900. As shown in FIG. 2, the control box 924 can include a power supply 934, a processor 936, a memory 937, a switching mechanism 938, and an analog to digital (A/D) converter 940. The switching mechanism 938 can be, for example, a relay or a solid state switch. In some implementations, the switching mechanism 938 can be located in the pump 920 rather than the control box 924.

The pump 920 and the remote control 922 are in two-way communication with the control box 924. The pump 920 includes a motor 942, a pump manifold 943, a relief valve 944, a first control valve 945A, a second control valve 945B, and a pressure transducer 946. The pump 920 is fluidly connected with the first air chamber 906A and the second air chamber 906B via a first tube 948A and a second tube 948B, respectively. The first and second control valves 945A and 945B can be controlled by switching mechanism 938, and are operable to regulate the flow of fluid between the pump 920 and first and second air chambers 906A and 906B, respectively.

In some implementations, the pump 920 and the control box 924 can be provided and packaged as a single unit. In some alternative implementations, the pump 920 and the control box 924 can be provided as physically separate units. In some implementations, the control box 924, the pump 920, or both are integrated within or otherwise contained within a bed frame or bed support structure that supports the bed 912. In some implementations, the control box 924, the pump 920, or both are located outside of a bed frame or bed support structure (as shown in the example in FIG. 8).

The example air bed system 900 depicted in FIG. 8 includes the two air chambers 906A and 906B and the single pump 920. However, other implementations can include an air bed system having two or more air chambers and one or more pumps incorporated into the air bed system to control the air chambers. For example, a separate pump can be associated with each air chamber of the air bed system or a pump can be associated with multiple chambers of the air bed system. Separate pumps can allow each air chamber to be inflated or deflated independently and simultaneously. Furthermore, additional pressure transducers can also be incorporated into the air bed system such that, for example, a separate pressure transducer can be associated with each air chamber.

In use, the processor 936 can, for example, send a decrease pressure command to one of air chambers 906A or 906B, and the switching mechanism 938 can be used to convert the low voltage command signals sent by the processor 936 to higher operating voltages sufficient to operate the relief valve 944 of the pump 920 and open the control valve 945A or 945B. Opening the relief valve 944 can allow air to escape from the air chamber 906A or 906B through the respective air tube 948A or 948B. During deflation, the pressure transducer 946 can send pressure readings to the processor 936 via the A/D converter 940. The A/D converter 940 can receive analog information from pressure transducer 946 and can convert the analog information to digital information useable by the processor 936. The processor 936 can send the digital signal to the remote control 922 to update the display 926 in order to convey the pressure information to the user.

As another example, the processor 936 can send an increase pressure command. The pump motor 942 can be energized in response to the increase pressure command and send air to the designated one of the air chambers 906A or 906B through the air tube 948A or 948B via electronically operating the corresponding valve 945A or 945B. While air is being delivered to the designated air chamber 906A or 906B in order to increase the firmness of the chamber, the pressure transducer 946 can sense pressure within the pump manifold 943. Again, the pressure transducer 946 can send pressure readings to the processor 936 via the A/D converter 940. The processor 936 can use the information received from the A/D converter 940 to determine the difference between the actual pressure in air chamber 906A or 906B and the desired pressure. The processor 936 can send the digital signal to the remote control 922 to update display 926 in order to convey the pressure information to the user.

Generally speaking, during an inflation or deflation process, the pressure sensed within the pump manifold 943 can provide an approximation of the pressure within the respective air chamber that is in fluid communication with the pump manifold 943. An example method of obtaining a pump manifold pressure reading that is substantially equivalent to the actual pressure within an air chamber includes turning off pump 920, allowing the pressure within the air chamber 906A or 906B and the pump manifold 943 to equalize, and then sensing the pressure within the pump manifold 943 with the pressure transducer 946. Thus, providing a sufficient amount of time to allow the pressures within the pump manifold 943 and chamber 906A or 906B to equalize can result in pressure readings that are accurate approximations of the actual pressure within air chamber 906A or 906B. In some implementations, the pressure of the air chambers 906A and/or 906B can be continuously monitored using multiple pressure sensors (not shown).

In some implementations, information collected by the pressure transducer 946 can be analyzed to determine various states of a person lying on the bed 912. For example, the processor 936 can use information collected by the pressure transducer 946 to determine a heart rate or a respiration rate for a person lying in the bed 912. For example, a user can be lying on a side of the bed 912 that includes the chamber 906A. The pressure transducer 946 can monitor fluctuations in pressure of the chamber 906A and this information can be used to determine the user's heart rate and/or respiration rate. As another example, additional processing can be performed using the collected data to determine a sleep state of the person (e.g., awake, light sleep, deep sleep). For example, the processor 936 can determine when a person falls asleep and, while asleep, the various sleep states of the person.

Additional information associated with a user of the air bed system 900 that can be determined using information collected by the pressure transducer 946 includes motion of the user, presence of the user on a surface of the bed 912, weight of the user, heart arrhythmia of the user, and apnea. Taking user presence detection for example, the pressure transducer 946 can be used to detect the user's presence on the bed 912, e.g., via a gross pressure change determination and/or via one or more of a respiration rate signal, heart rate signal, and/or other biometric signals. For example, a simple pressure detection process can identify an increase in pressure as an indication that the user is present on the bed 912. As another example, the processor 936 can determine that the user is present on the bed 912 if the detected pressure increases above a specified threshold (so as to indicate that a person or other object above a certain weight is positioned on the bed 912). As yet another example, the processor 936 can identify an increase in pressure in combination with detected slight, rhythmic fluctuations in pressure as corresponding to the user being present on the bed 912. The presence of rhythmic fluctuations can be identified as being caused by respiration or heart rhythm (or both) of the user. The detection of respiration or a heartbeat can distinguish between the user being present on the bed and another object (e.g., a suit case) being placed upon the bed.

In some implementations, fluctuations in pressure can be measured at the pump 920. For example, one or more pressure sensors can be located within one or more internal cavities of the pump 920 to detect fluctuations in pressure within the pump 920. The fluctuations in pressure detected at the pump 920 can indicate fluctuations in pressure in one or both of the chambers 906A and 906B. One or more sensors located at the pump 920 can be in fluid communication with the one or both of the chambers 906A and 906B, and the sensors can be operative to determine pressure within the chambers 906A and 906B. The control box 924 can be configured to determine at least one vital sign (e.g., heart rate, respiratory rate) based on the pressure within the chamber 906A or the chamber 906B.

In some implementations, the control box 924 can analyze a pressure signal detected by one or more pressure sensors to determine a heart rate, respiration rate, and/or other vital signs of a user lying or sitting on the chamber 906A or the chamber 906B. More specifically, when a user lies on the bed 912 positioned over the chamber 906A, each of the user's heart beats, breaths, and other movements can create a force on the bed 912 that is transmitted to the chamber 906A. As a result of the force input to the chamber 906A from the user's movement, a wave can propagate through the chamber 906A and into the pump 920. A pressure sensor located at the pump 920 can detect the wave, and thus the pressure signal output by the sensor can indicate a heart rate, respiratory rate, or other information regarding the user.

With regard to sleep state, air bed system 900 can determine a user's sleep state by using various biometric signals such as heart rate, respiration, and/or movement of the user. While the user is sleeping, the processor 936 can receive one or more of the user's biometric signals (e.g., heart rate, respiration, and motion) and determine the user's present sleep state based on the received biometric signals. In some implementations, signals indicating fluctuations in pressure in one or both of the chambers 906A and 906B can be amplified and/or filtered to allow for more precise detection of heart rate and respiratory rate.

The control box 924 can perform a pattern recognition algorithm or other calculation based on the amplified and filtered pressure signal to determine the user's heart rate and respiratory rate. For example, the algorithm or calculation can be based on assumptions that a heart rate portion of the signal has a frequency in the range of 0.5-4.0 Hz and that a respiration rate portion of the signal a has a frequency in the range of less than 1 Hz. The control box 924 can also be configured to determine other characteristics of a user based on the received pressure signal, such as blood pressure, tossing and turning movements, rolling movements, limb movements, weight, the presence or lack of presence of a user, and/or the identity of the user. Techniques for monitoring a user's sleep using heart rate information, respiration rate information, and other user information are disclosed in U.S. Patent Application Publication No. 20100170043 to Steven J. Young et al., titled "APPARATUS FOR MONITORING VITAL SIGNS," the entire contents of which is incorporated herein by reference.

For example, the pressure transducer 946 can be used to monitor the air pressure in the chambers 906A and 906B of the bed 912. If the user on the bed 912 is not moving, the air pressure changes in the air chamber 906A or 906B can be relatively minimal, and can be attributable to respiration and/or heartbeat. When the user on the bed 912 is moving, however, the air pressure in the mattress can fluctuate by a much larger amount. Thus, the pressure signals generated by the pressure transducer 946 and received by the processor 936 can be filtered and indicated as corresponding to motion, heartbeat, or respiration.

In some implementations, rather than performing the data analysis in the control box 924 with the processor 936, a digital signal processor (DSP) can be provided to analyze the data collected by the pressure transducer 946. Alternatively, the data collected by the pressure transducer 946 could be sent to a cloud-based computing system for remote analysis.

In some implementations, the example air bed system 900 further includes a temperature controller configured to increase, decrease, or maintain the temperature of a bed, for example for the comfort of the user. For example, a pad can be placed on top of or be part of the bed 912, or can be placed on top of or be part of one or both of the chambers 906A and 906B. Air can be pushed through the pad and vented to cool off a user of the bed. Conversely, the pad can include a heating element that can be used to keep the user warm. In some implementations, the temperature controller can receive temperature readings from the pad. In some implementations, separate pads are used for the different sides of the bed 912 (e.g., corresponding to the locations of the chambers 906A and 906B) to provide for differing temperature control for the different sides of the bed.

In some implementations, the user of the air bed system 900 can use an input device, such as the remote control 922, to input a desired temperature for the surface of the bed 912 (or for a portion of the surface of the bed 912). The desired temperature can be encapsulated in a command data structure that includes the desired temperature as well as identifies the temperature controller as the desired component to be controlled. The command data structure can then be transmitted via Bluetooth or another suitable communication protocol to the processor 936. In various examples, the command data structure is encrypted before being transmitted. The temperature controller can then configure its elements to increase or decrease the temperature of the pad depending on the temperature input into remote control 922 by the user.

In some implementations, data can be transmitted from a component back to the processor 936 or to one or more display devices, such as the display 926. For example, the current temperature as determined by a sensor element of temperature controller, the pressure of the bed 912, the current position of the foundation or other information can be transmitted to control box 924. The control box 924 can then transmit the received information to remote control 922 where it can be displayed to the user (e.g., on the display 926).

In some implementations, the example air bed system 900 further includes an adjustable foundation and an articulation controller configured to adjust the position of a bed (e.g., the bed 912) by adjusting the adjustable foundation that supports the bed. For example, the articulation controller can adjust the bed 912 from a flat position to a position in which a head portion of a mattress of the bed is inclined upward (e.g., to facilitate a user sitting up in bed and/or watching television). In some implementations, the bed 912 includes multiple separately articulable sections. For example, portions of the bed corresponding to the locations of the chambers 906A and 906B can be articulated independently from each other, to allow one person positioned on the bed 912 surface to rest in a first position (e.g., a flat position) while a second person rests in a second position (e.g., an reclining position with the head raised at an angle from the waist). In some implementations, separate positions can be set for two different beds (e.g., two twin beds placed next to each other). The foundation of the bed 912 can include more than one zone that can be independently adjusted. The articulation controller can also be configured to provide different levels of massage to one or more users on the bed 912.

While this specification contains many specific implementation details, these should not be construed as limitations on the scope of the disclosed technology or of what may be claimed, but rather as descriptions of features that may be specific to particular embodiments of particular disclosed technologies. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims. For example, in some embodiments the mattress system 100 can include more or fewer foam structures and/or air chambers than those illustrated. Moreover, in some embodiments the mattress system 100 can include additional features not depicted, such as coil springs, comfort layers, sensors, or other support structures.

What is claimed is:

1. A mattress comprising:

a mattress core; and a foam chamber surrounding six sides of the mattress core, the foam chamber including a top layer opposite a bottom layer, the top layer configured to be positioned between the core and a user of the mattress, the bottom layer extends below the mattress core, the bottom layer having a slit that continuously extends through an entire thickness of the bottom layer and along a midline of the bottom layer from a head end to a foot end of the bottom layer, the slit separating a first portion of the bottom layer from a second portion of the bottom layer.

2. The mattress of claim 1, wherein the mattress core is an inflatable air chamber.

3. The mattress of claim 1, wherein the foam chamber includes a plurality of connected layers, wherein the slit in the bottom layer allows the mattress core to be inserted into the foam chamber.

4. The mattress of claim 3, wherein the first portion and the second portion of the bottom layer are laminated to opposing side rails of the foam chamber.

5. The mattress of claim 1, wherein the foam chamber includes:

a comfort layer laminated to side rails; and a bottom layer laminated to the side rails, wherein a core space is defined by the bottom layer, the comfort layer, and the side rails, wherein the core space is sized to fit the mattress core.

6. A mattress comprising:

a mattress core;

a top layer configured to be positioned between the core and a user of the mattress;

a perimeter rail structure that extends around a perimeter of the core; and a bottom layer that extends below the mattress core and the perimeter rail structure, the bottom layer including a first portion and a second portion that are separated by a slit that allows the mattress core to be inserted into the perimeter rail structure, the slit continuously extends through an entire thickness of the bottom layer and along a midline of the bottom layer from a head end to a foot end of the bottom layer.

7. The mattress of claim 6, wherein the first portion and the second portion are adhered to opposing side rails of the perimeter rail structure.

8. The mattress of claim 6, further comprising:

a comfort layer laminated to the perimeter rail structure; and wherein a core space is defined by the bottom layer, the comfort layer, and the perimeter rail structure and the core space is sized to receive the mattress core.

9. The mattress of claim 6, wherein the mattress core includes one or more air chambers.

10. The mattress of claim 9, wherein the one or more air chambers includes a first air chamber and a second air chamber that extend from a head of the mattress to a foot of the mattress.

11. The mattress of claim 10, wherein the air chambers are connected to each other along a midline of the mattress.

12. The mattress of claim 9, further comprising a pump system having one or more air pumps fluidly connected to a first air chamber and a second air chamber, wherein the pump system is configured to inflate the first and second air chambers, and wherein the first and second portions of the bottom layer define first and second openings extending through the first and second portions proximate the perimeter rail structure through which first and second hoses extend to the first and second air chambers.

13. The mattress of claim 9, further comprising means for inflating the one or more air chambers.

14. The mattress of claim 6, wherein the core includes one or more foam layers.

15. The mattress of claim 6, wherein the perimeter rail structure combines with the top layer to form an inverted foam tub that surrounds top and side portions of the core.

16. The mattress of claim 6, wherein the perimeter rail structure includes one or more foam rails including a head rail, a foot rail, and first and second side rails, wherein the first portion is adhered to the first side rail but not the second side rail, the head rail, or the foot rail, and wherein the second portion is adhered to the second side rail, but not the first side rail, the head rail, or the foot rail.

17. The mattress of claim 6, wherein the perimeter rail structure includes one or more foam rails including a head rail, a foot rail, and first and second side rails that each extend between the head rail and the foot rail above the bottom layer, wherein the first portion is adhered to the first side rail along a length of the first side rail, wherein the first portion is adhered to only a corner portion of the head rail, wherein the first portion is adhered to only a corner portion of the foot rail, and wherein the first portion is not adhered to the second side rail, and wherein the second portion is adhered to the second side rail along a length of the second side rail, wherein the second portion is adhered to only a corner portion of the head rail, wherein the second portion is adhered to only a corner portion of the foot rail, and wherein the second portion is not adhered to the first side rail.

18. The mattress of claim 6, further comprising a mattress cover that encloses the mattress core, the top layer, the perimeter rail structure, and the bottom layer.

19. The mattress of claim 17, wherein a top surface of the first portion adheres to a bottom surface of the first side rail, and a top surface of the second portion adheres to a bottom surface of the second side rail.

* * * * *